US005588568A

United States Patent [19]

Flavin et al.

[11] Patent Number: 5,588,568

[45] Date of Patent: Dec. 31, 1996

[54] EYELET THREADER

[76] Inventors: James M. Flavin; Myra E. Flavin, both of 2966 Foxcroft Dr., Tallahassee, Fla. 32308

[21] Appl. No.: 504,425

[22] Filed: Jul. 20, 1995

[51] Int. Cl.[6] ..... D05B 87/02; D05B 87/00

[52] U.S. Cl. ..... 223/99

[58] Field of Search ..... 223/111, 102, 223/99, 101; 112/224, 225

[56] References Cited

U.S. PATENT DOCUMENTS

| | | | |
|---|---|---|---|
| 171,654 | 1/1876 | Ellis | 223/99 |
| D. 288,622 | 3/1987 | Biemans | D3/28 |
| 2,807,397 | 9/1957 | Fugelseth | 223/99 |
| 2,991,809 | 7/1961 | Hughes | 223/99 |
| 4,832,240 | 5/1989 | Dalbo | 223/99 |
| 4,838,426 | 6/1989 | Dalbo | 206/574 |
| 4,911,341 | 3/1990 | Davis | 223/99 |
| 4,913,325 | 4/1990 | Cackedo | 223/99 |
| 4,930,871 | 6/1990 | Tannahill | 350/243 |
| 4,972,979 | 11/1990 | Gordon | 223/99 |
| 5,251,797 | 10/1993 | Martin | 223/99 |

FOREIGN PATENT DOCUMENTS

| | | | |
|---|---|---|---|
| 83289 | 12/1919 | Switzerland | 223/99 |

*Primary Examiner*—Bibhu Mohanty
*Attorney, Agent, or Firm*—Peter Loffler

[57] ABSTRACT

An eyelet threader is disclosed. The device comprises a resilient loop in conjunction with a guide means. The guide means is used in order to help pass the resilient loop through the eye of a needle. Once so passed, the resilient loop is slightly depressed in order to form a bulbed end. Thread is passed through the bulbed end and the needle withdrawn from the resilient loop thereby threading the needle.

5 Claims, 1 Drawing Sheet

FIG. 1
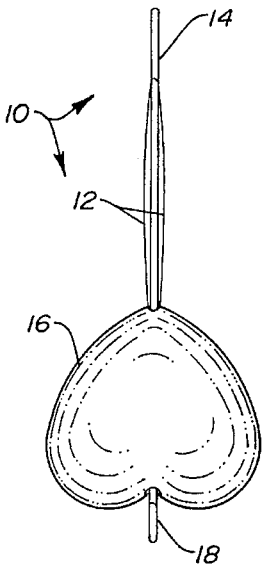
FIG. 2
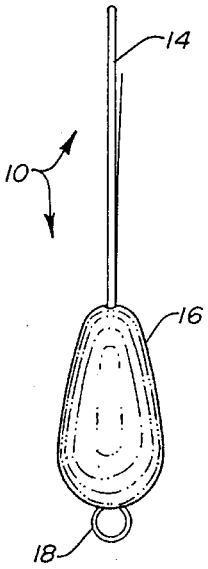
FIG. 4
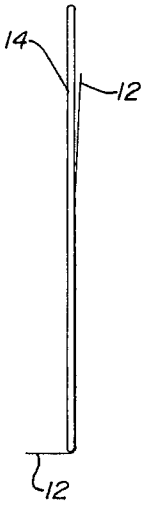
FIG. 3
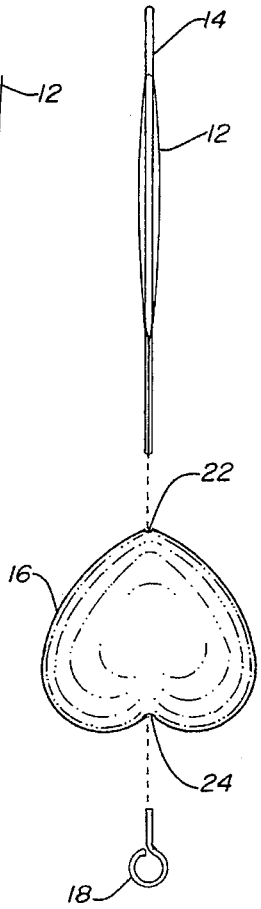
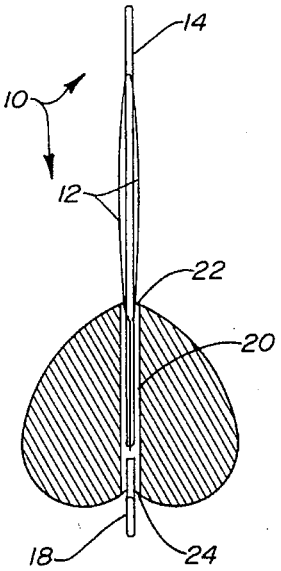
FIG. 5
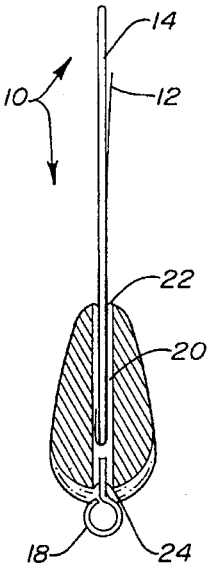
FIG. 6
FIG. 7
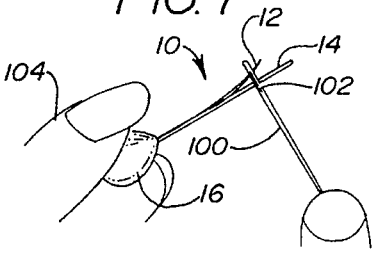
FIG. 8
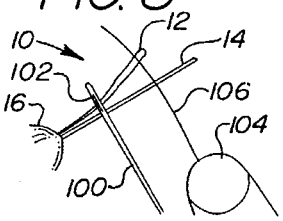
FIG. 9
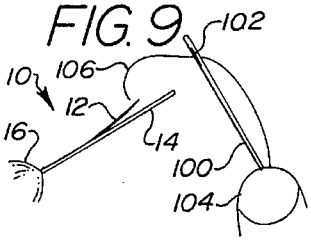

EYELET THREADER

BACKGROUND OF THE INVENTION

1. Field of the Invention

The present invention relates an eyelet threader and more particularly to an eyelet threader having a guide for ease of use.

2. Background of the Prior Art

Anyone who has tried to thread a needle, or similar device, can attest to the difficulty and frustration associated with the task. To help in this task, devices have been proposed to assist in the threading operation, which devices are well known in the art. Two basic types of devices have emerged as being relatively successful in accomplishing the threading task.

The first type of threading device, exemplified in U.S. Pat. No. 4,832,240 issued to Dalbo, relies on a notch which retains a needle while an eye holds thread and threads the needle when the needle is removed from the device. Although this type of device works reasonably well with large eyelet needles, it is ill suited for small eyelet needles.

The second type of threading device, exemplified by U.S. Pat. No 5,251,797 issued to Martin, relies on a resilient loop that holds a thread and is pulled through the eyelet of a needle. This type of device suffers from the fact that the needle to be threaded must be held by the user in order to pass the resilient loop through the eyelet. As such, it often proves difficult to hold the device and the needle steady in order to pass the resilient loop through the eyelet.

Therefore, there is a need in the art for a needle threading device that can thread any size needle quickly and efficiently. Such a device should be relatively simple and inexpensive to manufacture.

SUMMARY OF THE INVENTION

The device of the present invention meets the abovestated needs in the art. The present invention provides a needle threader that can be utilized with any size needle, or other devices such as hooks, bearing any size eyelet. The device is simple to use ahd threads the needle relatively quickly.

The needle threader of the present invention comprises a deformable resilient loop and a guide means. The resilient loop is passed through the eyelet of a needle. The resilient loop is sufficiently small so that it can pass through any size needle eyelet. The guide means, which is a post member, is used to assist in passing the resilient loop through the eyelet of the needle. A finger grip is located on the end of the guide means for ease of handling of the device.

The use of the resilient 1loop assures that any size needle can be threaded by the present invention. The guide means assures that the resilient loop can be quickly passed through the eyelet of the needle.

BRIEF DESCRIPTION OF THE DRAWINGS

FIG. 1 is a front elevation view of the device of the present invention.

FIG. 2 is a side elevation view of the device of the present invention.

FIG. 3 is an exploded view of FIG. 1.

FIG. 4 is a side elevation view of the guide post and resilient loop.

FIG. 5 is a cutaway view of FIG. 1.

FIG. 6 is a cutaway view of FIG. 2.

FIGS. 7–9 show the method to utilize the invention to thread a needle.

Similar reference numerals refer to similar parts throughout the several views of the drawings.

DETAILED DESCRIPTION OF THE PREFERRED EMBODIMENT

The eyelet threader 10 of the present invention comprises a resilient closed loop 12, and a guide means 14. The guide means 14 is a straight rigid post member. The resilient loop 12 is made from wire, plastic, or other similar material. The resilient loop 12 can be attached to the base of the guide means 14 by any appropriate method. From the point of attachment, the resilient loop 12 and the guide means 14 are disposed in near parallel and close proximate relation to one another. The end of the guide means 14 terminates beyond the end of the resilient loop 12. The end of the resilient loop 12 may optionally flare outwardly from the guide means 14.

Locatable on the end of the resilient loop 12 and the guide means 14 is a finger grip 16. As seen in FIGS. 5 and 6, the finger grip 16 has a hollow channel 20 with a first opening 22 and a second opening 24. The resilient loop 12 and the guide means 14 are disposed within the hollow channel 20 and protrude through first opening 22 through first opening 22. The resilient loop 12 and the guide means 14 can be secured within hollow channel 20 by any appropriate means.

Disposable within second opening 24 is a keyhole 18 for permitting the device 10 to be attached to a chain (not shown).

By way of example, the finger grip 16 is illustrated as an ornamental heart, however, it is expressly recognized that a finger grip of any appropriate shape, size, and style can be utilized with the device 10.

Referring now to FIGS. 7–9, the finger grip 16 is held by a user's finger 104. The eyelet end 102 of a needle 100 is placed on the end of a guide means 14 such that eye 102 of the needle 100 is positioned near the end of the resilient loop 12. The needle 100 is guided along the guide means 14 until the resilient loop 12 passes through the eyelet 102 of the needle 100. The optional flared end of the resilient loop 12 helps the resilient loop 12 pass through the eyelet 102. Once the resilient loop 12, has passed through the eyelet 102, the end of the resilient loop 12 is depressed slightly to form a bulb (Alternatively, the end of the resilient loop 12 may be pre-formed with the bulbed or separated end). A thread 106 is passed through the bulb. The needle 100 is withdrawn from the resilient loop 12 thereby threading the needle 100.

While the invention has been particularly shown and described with reference to an embodiment thereof, it will be understood by those skilled in the art that various changes in form and detail may be made without departing from the spirit and scope of the invention.

I claim:

1. An eyelet threader for threading a needle comprising:

a resiliently deformable closed loop member, having a first end for insertion through an eyelet of a needle and receiving a thread therethrough and a second end;

a post member having a first end for insertion in the eyelet of a needle and for guiding the loop member through the eyelet, wherein said po disposed in generally parallel adjacent orientation to the loop member with the second end of the loop member attached to a second end of the post.

2. The device as in claim 1 wherein the second end of the post member and the second end of the loop member are affixed to a finger grip.

3. The device as in claim 1 wherein the first end of the resiliently deformable loop member is flared.

4. The device as in claim 1 wherein the post member and the resiliently deformable loop member are affixed to a finger grip.

5. The device as in claim 2 further including a keyhole affixed to the finger grip.

* * * * *